US008956189B2

(12) United States Patent
Imahori et al.

(10) Patent No.: US 8,956,189 B2
(45) Date of Patent: Feb. 17, 2015

(54) CONNECTION STRUCTURE BETWEEN SHIELD SHELL AND BRAIDED SHIELD AND WIRE HARNESS

(71) Applicant: Hitachi Cable, Ltd., Tokyo (JP)

(72) Inventors: Masaaki Imahori, Hitachinaka (JP); Nobuyuki Yamashita, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 69 days.

(21) Appl. No.: 13/898,757

(22) Filed: May 21, 2013

(65) Prior Publication Data

US 2013/0316582 A1 Nov. 28, 2013

(30) Foreign Application Priority Data

May 22, 2012 (JP) ..... 2012-116512

(51) Int. Cl.

| | |
|---|---|
| ***H01R 13/648*** | (2006.01) |
| ***H01R 4/10*** | (2006.01) |
| ***H01R 13/6592*** | (2011.01) |
| *H01R 9/03* | (2006.01) |
| *H01R 105/00* | (2006.01) |

(52) U.S. Cl.

CPC ..... *H01R 4/10* (2013.01); *H01R 13/6592* (2013.01); *H01R 9/032* (2013.01); *H01R 2105/00* (2013.01)

USPC ..... 439/607.55; 439/587

(58) Field of Classification Search

CPC ..... H01R 4/646; H01R 9/05; H01R 9/0503; H01R 13/506; H01R 13/5208; H01R 13/658; H01R 13/748; H02G 15/013

USPC ..... 439/98, 564, 607.41, 607.52, 607.55, 439/587, 904, 905

See application file for complete search history.

(56) References Cited

U.S. PATENT DOCUMENTS

| | | | | |
|---|---|---|---|---|
| 5,401,177 | A * | 3/1995 | Dutton et al. | 439/98 |
| 6,781,059 | B2 * | 8/2004 | Mizutani | 174/75 C |
| 6,864,426 | B2 * | 3/2005 | Miyazaki | 174/75 C |
| 7,041,907 | B2 * | 5/2006 | Miyazaki | 174/72 A |
| 7,331,823 | B2 | 2/2008 | Fukushima et al. | |
| 7,614,910 | B2 * | 11/2009 | Croteau et al. | 439/573 |
| 7,666,032 | B2 * | 2/2010 | Aoki et al. | 439/607.41 |
| 7,731,543 | B2 * | 6/2010 | Aoki et al. | 439/697 |
| 8,191,250 | B2 * | 6/2012 | Kawase et al. | 29/857 |
| 8,460,015 | B2 * | 6/2013 | Deno et al. | 439/98 |
| 8,641,441 | B2 * | 2/2014 | Aoki et al. | 439/345 |
| 8,790,137 | B2 * | 7/2014 | Deno et al. | 439/607.41 |

FOREIGN PATENT DOCUMENTS

| | | |
|---|---|---|
| JP | 2003-142211 | 5/2003 |
| JP | 2005-339933 A | 12/2005 |

OTHER PUBLICATIONS

Japanese Office Action dated Aug. 19, 2014 and English translation of notification of reasons for refusal.

* cited by examiner

*Primary Examiner* — Thanh Tam Le

(74) *Attorney, Agent, or Firm* — Roberts Mlotkowski Safran & Cole P.C.

(57) ABSTRACT

A connection structure includes a shield shell enclosing a part of a plurality of wires, a braided shield collectively covering the plurality of wires, a belt-shaped clamping member sandwiching the braided shield between it and an outer surface of the shield shell so as to press the braided shield against the shield shell by a clamping force thereof, and an annular member disposed between the braided shield and the clamping member and having an elasticity to be deformed by the clamping force of the clamping member. The clamping member presses the braided shield against the shield shell through the annular member.

5 Claims, 5 Drawing Sheets

CONNECTION STRUCTURE BETWEEN SHIELD SHELL AND BRAIDED SHIELD AND WIRE HARNESS

The present application is based on Japanese patent application No. 2012-116512 filed on May 22, 2012, the entire contents of which are incorporated herein by reference.

BACKGROUND OF THE INVENTION

1. Field of the Invention

The invention relates to a connection structure between a shield shell and a braided shield and to a wire harness using the connection structure.

2. Description of the Related Art

A structure for fixing a braided shield to a shield shell is known that the braided shield is formed by braiding plural conductive wires and covers plural wires (see, e.g., JP-A-2005-339933).

The structure for fixing a braided shield described in JP-A-2005-339933 is configured such that the braided shield with an enlarged inner diameter is fitted to an oval ring portion of the shield shell and is clamped by a band. The band has a racetrack shape corresponding to an outer surface of the ring portion and presses the braided shield toward the ring portion of the shield shell by diameter reduction caused by fastening a bolt and a nut which are provided at a longitudinal end of the belt.

SUMMARY OF THE INVENTION

In securing the braided shield to the shield shell, it is desirable that a clamping force of the band be applied to the braided shield (conductive wires) in an area as large as possible in order to ensure electrical connection between the braided shield and the shield shell and to prevent the braided shield from slipping off. However, the fixing structure disclosed in JP-A-2005-339933 is configured such that the braided shield is pressed against the shield shell by contact with the band. Therefore, even if the clamping force of the band is increased, the clamping force is concentrated on a portion of the braided shield and it is poorly effective to apply the clamping force of the band to the braided shield in a large area.

It is an object of the invention to provide a connection structure between a shield shell and a braided shield that allows a clamping force of a clamping member to act on the braided shield in a larger area than the case of pressing the braided shield against the shield shell by contact with the clamping member, as well as a wire harness using the connection structure.

(1) According to one embodiment of the invention, a connection structure comprises:
- a shield shell enclosing a part of a plurality of wires;
- a braided shield collectively covering the plurality of wires;
- a belt-shaped clamping member sandwiching the braided shield between it and an outer surface of the shield shell so as to press the braided shield against the shield shell by a clamping force thereof; and
- an annular member disposed between the braided shield and the clamping member and having an elasticity to be deformed by the clamping force of the clamping member,
- wherein the clamping member presses the braided shield against the shield shell through the annular member.

In the above embodiment (1) of the invention, the following modifications and changes can be made.
- (i) The annular member comprises a tape wound several times so as to surround the braided shield.
- (ii) A region of the shield shell facing an inside of the annular member comprises a convex arc shape at an entire circumference thereof and an outer surface thereof in a cross section orthogonal to an extending direction of the wires.
- (iii) The annular member comprises a tape with an adhesive layer formed on one surface thereof.

(2) According to another embodiment of the invention, a wire harness comprises:
- a plurality of wires;
- a shield shell enclosing a part of the plurality of wires;
- a braided shield collectively covering the plurality of wires and contacting an outer surface of the shield shell;
- a belt-shaped clamping member sandwiching the braided shield between it and the an outer surface of the shield shell so as to press the braided shield against the shield shell by a clamping force thereof; and
- an annular member disposed between the braided shield and the clamping member and having an elasticity to be deformed by the clamping force of the clamping member.

Points of the Invention

According to one embodiment of the invention, a connection structure is constructed such that a braided shield, an annular member and a clamping member are sequentially provided on the outer surface of an accommodating portion of a shield shell. Thus, due to the elasticity of the annular member, the clamping force of the clamping member can be applied even to such a region that the clamping force of the clamping member would not be applied in the absence of the annular member. Thereby, the braided shield can be pressed against the outer surface of the accommodating portion of the shield shell. Therefore, a force of pressing the braided shield against the shield shell can be equalized by the annular member so as to increase an area of the braided shield to which the clamping force of the clamping member is applied.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Embodiment

Figure 1:
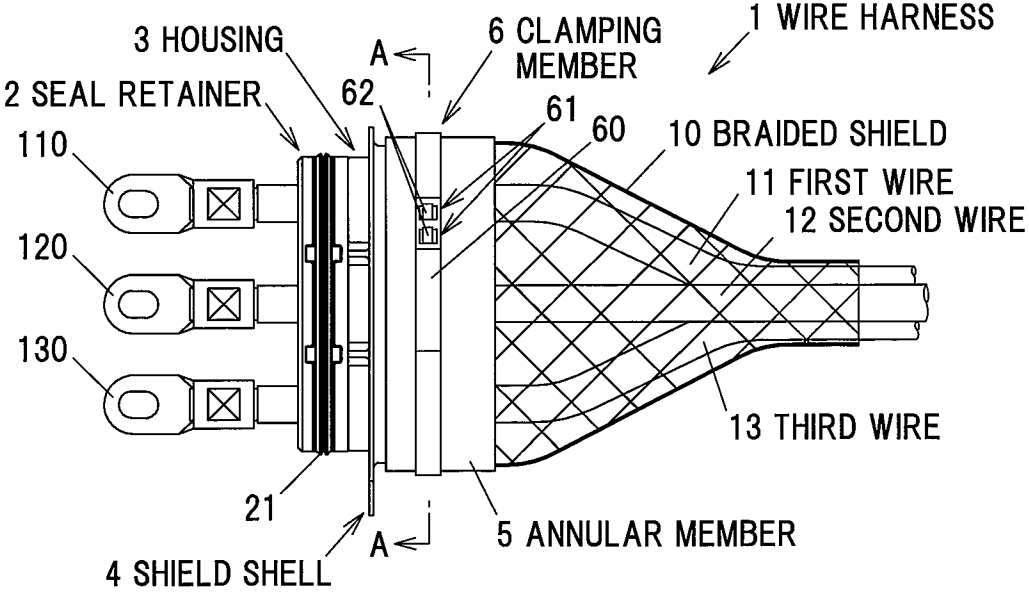
FIG. 1 is a structural view showing a connection structure between a shield shell and a braided shield in an embodiment of the present invention and an example of a wire harness provided with such a connection structure.
Figure 2:
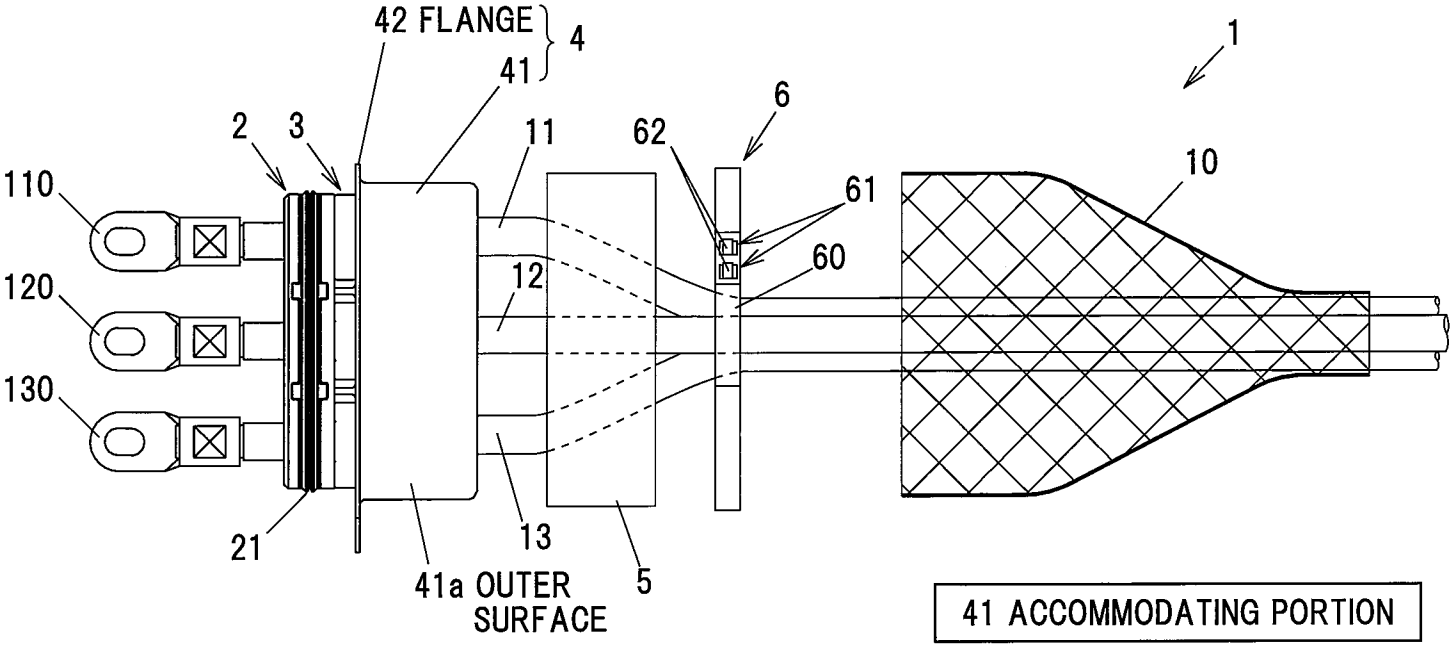
FIG. 2 is an exploded view of the wire harness shown in FIG. 1.

FIG. 1 is a structural view showing a connection structure between a shield shell and a braided shield in the embodiment of the invention and an example of a wire harness provided with such a connection structure. FIG. 2 is an exploded view of the wire harness shown in FIG. 1.

Figure 3A:
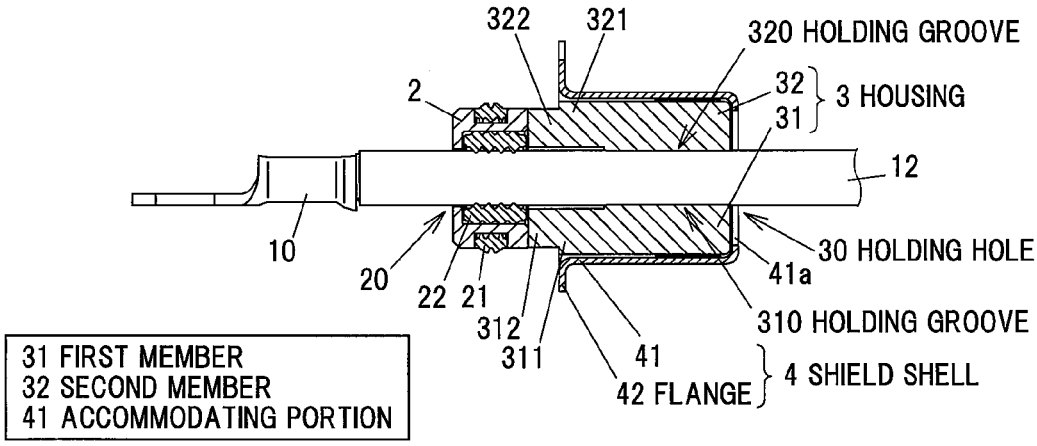
FIGS. 3A and 3B are explanatory cross sectional views showing structures of a seal retainer, a housing and a shield shell.
Figure 3B:
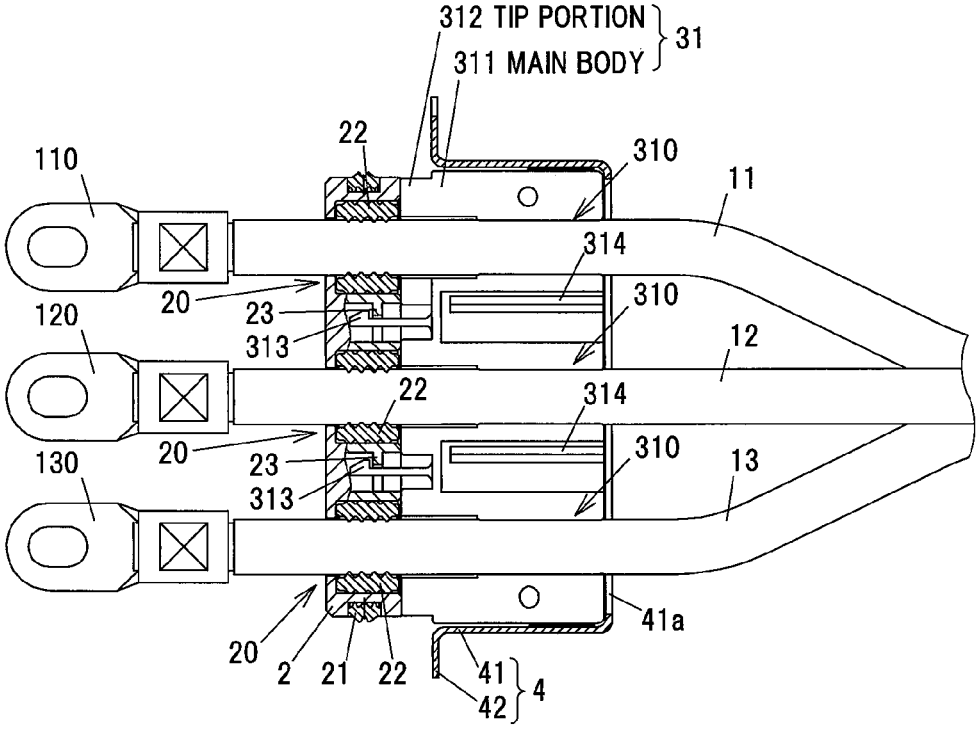
Figure 4B:
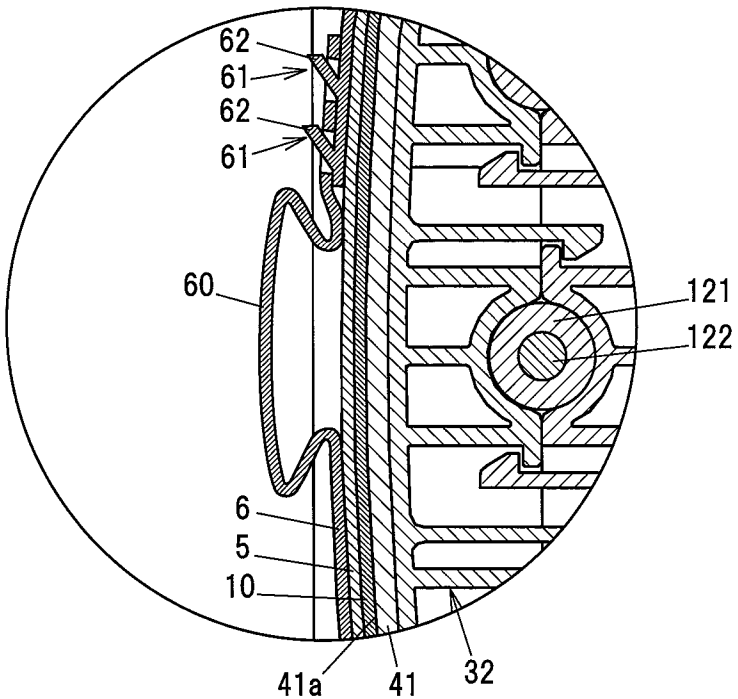
FIG. 4B is an enlarged view showing a major portion in FIG. 4A.
Figure 4A:
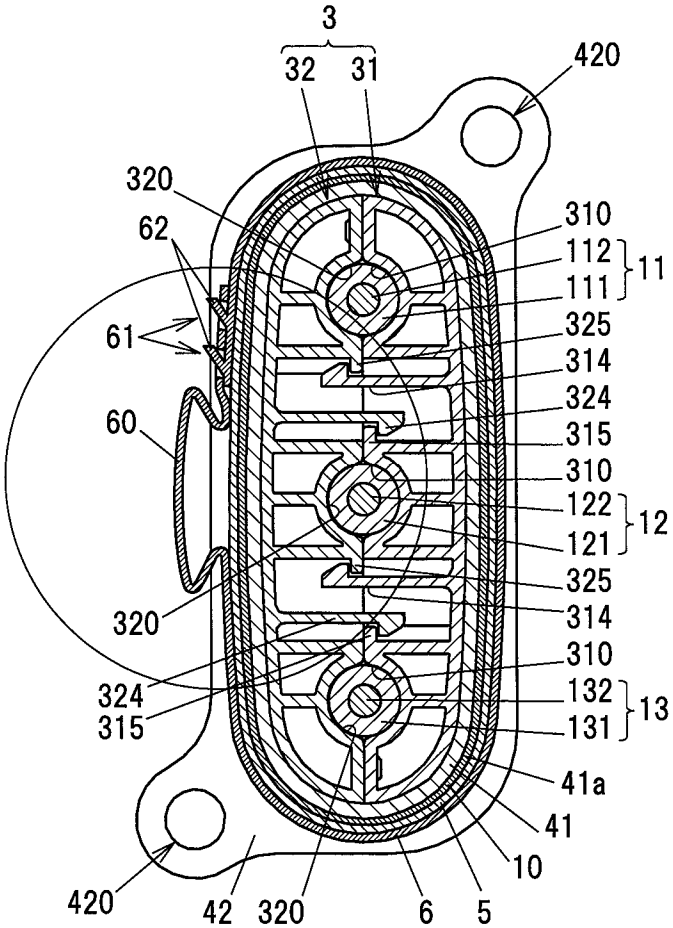
FIG. 4A is a cross sectional view taken on line A-A of FIG. 1
Figure 5:
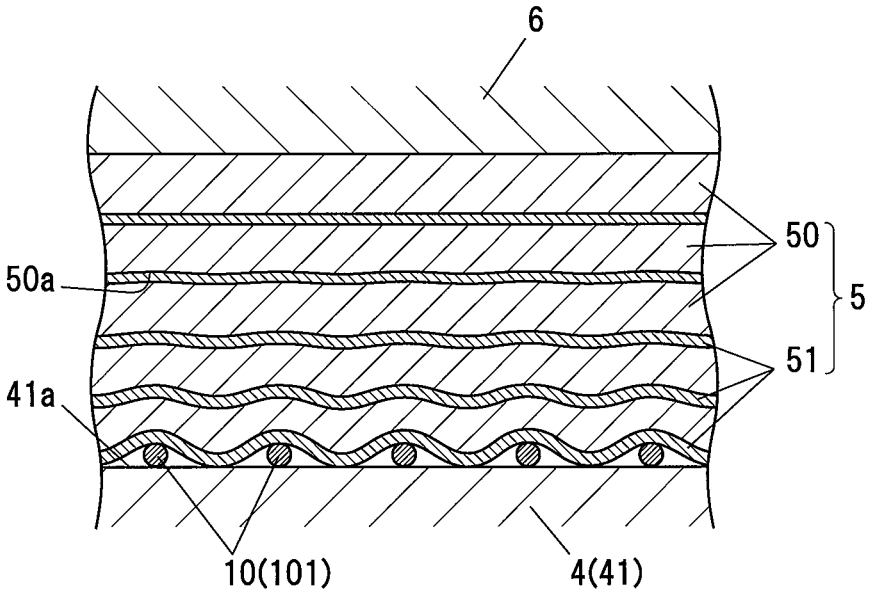
FIG. 5 is a further enlarged view of the cross section of an annular member 5 in FIGS. 4A and 4B.

FIGS. 3A and 3B are explanatory cross sectional views showing structures of a seal retainer 2, a housing 3 and a shield shell 4, wherein FIG. 3A is a cross sectional view showing the seal retainer 2, the housing 3 and the shield shell 4 taken along a second wire 12 and FIG. 3B is a cross sectional view showing a first member 31 constituting the housing 3, together with the seal retainer 2, the shield shell 4 and first to third wires 11 to 13. FIG. 4A is a cross sectional view taken on line A-A of FIG. 1 and FIG. 4B is an enlarged view showing a major portion in FIG. 4A. FIG. 5 is a further enlarged view of the cross section of an annular member 5 in FIGS. 4A and 4B.

A wire harness 1 is provided with the first to third wires 11 to 13, a braided shield 10 covering the first to third wires 11 to 13, the seal retainer 2 for inserting the first to third wires 11 to 13 and also for holding a sealing member 21 on an outer peripheral surface thereof, the housing 3 for holding the first to third wires 11 to 13, the shield shell 4 for accommodating a portion of the housing 3, the annular member 5 arranged so as to sandwich the braided shield 10 between itself and the shield shell 4 and a clamping member 6 arranged on an outer periphery of the annular member 5. The wire harness 1 is used for connecting, e.g., an inverter to a motor as a driving force for moving a vehicle.

The first to third wires 11 to 13 are wires for supplying, e.g., three-phase AC to a motor and have connecting terminals 110, 120 and 130 crimped and fixed at respective end portions on one side. In addition, the first to third wires 11 to 13 are respectively composed of cores 112, 122 and 132 and coverings 111, 121 and 131 formed of an insulating resin and covering the cores 112, 122 and 132, as shown in FIG. 4A.

The braided shield 10 is formed by braiding, e.g., conductive wires formed of metal such as copper alloy and covers the first to third wires 11 to 13 all together. At an end portion of the braided shield 10 to be connected to the shield shell 4, the inner diameter is enlarged by stretching mesh of the braid in a circumferential direction.

The shield shell 4 is formed of a conductive metal and integrally has a cylindrical accommodating portion 41 for accommodating a portion of the housing 3 and a flange 42 used for attaching the shield shell 4 to an attachment target device (a motor or an inverter, etc.). In the present embodiment, the shield shell 4 is formed of a tin-plated steel sheet. Two attachment through-holes 420 are formed on the flange 42, as shown in FIG. 4A.

The clamping member 6 is formed of a belt-shaped metal (e.g., stainless steel or iron) which is a different material from the shield shell 4, and is arranged so as to sandwich the braided shield 10 between itself and the outer surface 41*a* of the accommodating portion 41 of the shield shell 4. At one end of the clamping member 6, plural (two) openings 61 are formed. And at another end, protrusions 62 are formed as many as the number of the openings 61.

The clamping member 6 is wound around the annular member 5 so that the end portion having the openings 61 covers an outer periphery of the other end portion having the protrusions 62, and the clamping member 6 is clamped by a tool in a state that the protrusions 62 are fitted to the openings 61 so as to protrude therefrom, thereby generating a clamping force. A clamped portion 60 formed by the clamping is shaped into an Ω-shape which protrudes outward and curves in lateral view, as shown in FIGS. 4A and 4B.

The clamping member 6 presses the braided shield 10 against the accommodating portion 41 of the shield shell 4 by the clamping force thereof. Accordingly, the braided shield 10 comes into contact with the outer surface 41*a* of the shield shell 4 and is electrically connected to the shield shell 4.

The annular member 5 has elasticity to be deformed by the clamping force of the clamping member 6. An inner peripheral surface of the annular member 5 is in contact with the braided shield 10 and an outer peripheral surface is in contact with the clamping member 6. In the present embodiment, the annular member 5 is formed of a tape which is wound several times so as to surround the braided shield 10. The tape is, e.g., an acetate cloth tape. The thickness of the tape is, e.g., 0.2 mm, and accordingly, the annular member 5 in case of winding the tape 5 times has a thickness of 1 mm.

The annular member 5 is composed of a belt-shaped body 50 and an adhesive layer 51 which is tacky and is formed on a back surface 50*a* of the belt-shaped body 50. Note that, the thickness of the adhesive layer 51 is exaggeratingly shown in FIG. 5 for the purpose of explanation.

The annular member 5 is wound around the braided shield 10 so that the back surface 50*a* faces toward the braided shield 10. Accordingly, plural conductive wires 101 constituting the braided shield 10 sticks to the belt-shaped body 50 by the adhesive layer 51. In addition, the adhesive layer 51 is in contact with the outer surface 41*a* of the accommodating portion 41 of the shield shell 4 through the mesh formed between the plural conductive wires 101 and the belt-shaped body 50 thus sticks to also the shield shell 4.

The clamping member 6 presses the braided shield 10 against the shield shell 4 (the outer surface 41*a* of the accommodating portion 41) via the annular member 5. The annular member 5 has higher elasticity than the clamping member 6. In addition, the belt-shaped body 50 of the annular member 5 has a wider width than the clamping member 6.

The seal retainer 2 has three insertion holes 20 for respectively inserting the first to third wires 11 to 13, as shown in FIG. 3B. A sealing member 22 for sealing between an outer peripheral surface of the first, second or third wire 11, 12 or 13 and an inner peripheral surface of the insertion hole 20 is held on an inner surface of the insertion hole 20.

As shown in FIGS. 3A and 4A, the housing 3 is formed by coupling a first member 31 and a second member 32 which are formed of resin. The first member 31 has holding grooves 310 formed so as to respectively correspond to the first to third wires 11 to 13 and the second member 32 has holding grooves 320 formed so as to respectively correspond to the first to third wires 11 to 13 in the same manner. The holding grooves 310 and 320 have a semi-circular shape such that holding grooves 310 and holding grooves 320 form holding holes 30 (see FIG. 3A) for respectively holding the first to third wires 11 to 13 when the first member 31 is coupled to the second member 32.

As shown in FIG. 4A, two engaging pieces 314 of the first member 31 are engaged with two engaging protrusions 325 of the second member 32 and two engaging pieces 324 of the second member 32 are engaged with two engaging protrusions 315 of the first member 31, thereby coupling the first member 31 to the second member 32.

In region of the shield shell 4 (the accommodating portion 41) located inside the annular member 5, the outer surface 41*a* has a convex arc shape throughout the entire circumference in a cross section orthogonal to an extending direction of the first to third wires 11 to 13. The shape of the outer surface 41*a* is an oval shape having a major axis in an array direction of the first to third wires 11 to 13 (a vertical direction in FIG. 4A). In addition, a width in a minor axis direction orthogonal to the array direction (a horizontal width direction in FIG. 4A) is longest at the center of the major axis corresponding to a position of the second wire 12 and is gradually narrowed toward both end portions in the array direction. The outer surface 41*a* of the accommodating portion 41 is formed in a semi-circular shape at both end portions in the array direction of the first to third wires 11 to 13.

As shown in FIG. 4A, the braided shield 10, the annular member 5 and the clamping member 6 are arranged in this order on the outer side of the outer surface 41*a* of the accommodating portion 41. The annular member 5 shrinks by tightening the clamping member 6 so that the diameter thereof is reduced. The shrinkage is large at a portion receiving a large clamping force and is small at a portion receiving a small clamping force. In the present embodiment, the shrinkage is large at the both end portions in the array direction of the first to third wires 11 to 13 and decreases with an increase in distance from the both end portions.

As described above, even in such a region that the clamping force of the clamping member 6 would not act when the annular member 5 was not provided, the clamping force of the clamping member 6 is applied by elasticity of the annular member 5 and the braided shield 10 is pressed against the outer surface 41*a* of the accommodating portion 41 of the shield shell 4. As such, a force of pressing the braided shield 10 against the shield shell 4 is equalized by the annular member 5, which increases an area of the braided shield 10 on which the clamping force of the clamping member 6 acts.

Functions and Effects of the Embodiment

The following functions and effects are obtained in the first embodiment.

(1) The area of the conductive wires 101 constituting the braided shield 10 on which the clamping force of the clamping member 6 acts is increased by elasticity of the annular member 5. This allows the braided shield 10 to be more surely in contact with the shield shell 4 as compared to the case of not providing the annular member 5 and suppresses slip-off of the braided shield 10.

(2) The annular member 5 is interposed between the braided shield 10 and the clamping member 6, whereby the braided shield 10 is not directly in contact with the clamping member 6. Therefore, it is possible to prevent corrosion caused by contact between dissimilar metals.

(3) The annular member 5 is formed of a tape wound several times so as to surround the braided shield 10 and is thus easily assembled. In addition, since the inner surface of the annular member 5 sticks to the braided shield 10, slippage of the annular member 5 is suppressed at the time of clamping the clamping member 6 and it is thus possible to easily clamp the clamping member 6.

(4) Since the shape of the outer surface 41*a* in a cross section orthogonal to the extending direction of the first to third wires 11 to 13 is a convex arc shape throughout the entire circumference, a force of pressing the braided shield 10 against the shield shell 4 is more equalized than, e.g., the case of the outer surface 41*a* partially having a flat shape or a concave arc shape.

(5) Since the annular member 5 has the adhesive layer 51 on the back surface 50*a* of the belt-shaped body 50, an adhesive force acts between the annular member 5 and the shield shell 4 as well as the braided shield 10. As a result, it is possible to reduce wrinkles of the annular member 5 which are generated at the time of applying the clamping force of the clamping member 6 to the annular member 5, which allows the braided shield 10 to be more surely in contact with the shield shell 4. That is, wrinkles generated on the annular member 5 may create a region where the annular member 5 is not appropriately in contact with the conductive wires 101 of the braided shield 10. However, in the present embodiment, generation of wrinkles is suppressed by the adhesive layer 51 and this allows the braided shield 10 to be more surely in contact with the shield shell 4.

Although the embodiment of the invention has been described, the invention according to claims is not to be limited to the above-mentioned embodiment. Further, please note that all combinations of the features described in the embodiment are not necessary to solve the problem of the invention.

In addition, the invention can be appropriately modified and implemented without departing from the gist of the invention. For example, although the annular member 5 formed by winding a tape has been described in the embodiment, it is not limited thereto and a material of the annular member 5 may be, e.g., rubber or resin. In addition, the clamping member 6 is not limited to a member to be clamped and may be a member to be tightened by a bolt and a nut. In addition, the number of the wires is not limited to three and may be two or four. In addition, the intended purpose of the wire harness 1 is not specifically limited.

What is claimed is:

1. A connection structure, comprising:

a shield shell enclosing a part of a plurality of wires;

a braided shield collectively covering the plurality of wires;

a belt-shaped clamping member sandwiching the braided shield between the clamping member and an outer surface of the shield shell so as to press the braided shield against the shield shell by a clamping force thereof; and an annular member disposed between the braided shield and the clamping member and having an elasticity to be deformed by the clamping force of the clamping member, wherein the clamping member presses the braided shield against the shield shell through the annular member.

2. The connection structure according to claim 1, wherein the annular member comprises a tape wound several times so as to surround the braided shield.

3. The connection structure according to claim 1, wherein a region of the shield shell facing an inside of the annular member comprises a convex arc shape at an entire circumference thereof and an outer surface thereof in a cross section orthogonal to an extending direction of the wires.

4. The connection structure according to claim 1, wherein the annular member comprises a tape with an adhesive layer formed on one surface thereof.

5. A wire harness, comprising:

a plurality of wires;

a shield shell enclosing a part of the plurality of wires;

a braided shield collectively covering the plurality of wires and contacting an outer surface of the shield shell;

a belt-shaped clamping member sandwiching the braided shield between the clamping member and the an outer surface of the shield shell so as to press the braided shield against the shield shell by a clamping force thereof; and an annular member disposed between the braided shield and the clamping member and having an elasticity to be deformed by the clamping force of the clamping member.

* * * * *